United States Patent [19]

Lee

[11] 4,393,744

[45] Jul. 19, 1983

[54] PRESS FOR RELOADING RIFLE AND PISTOL CARTRIDGES

[76] Inventor: Richard J. Lee, 3146 Kettle Moraine Rd., Hartford, Wis. 53027

[21] Appl. No.: 280,677

[22] Filed: Jul. 6, 1981

[51] Int. Cl.[3] ..... F42B 33/02

[52] U.S. Cl. ..... 86/25; 86/31; 86/36; 86/39; 86/43; 86/44; 86/45

[58] Field of Search ..... 86/23, 25, 27, 31, 32, 86/36, 38, 39, 43, 44, 45

[56] References Cited

U.S. PATENT DOCUMENTS

| | | | |
|---|---|---|---|
| 3,336,829 | 8/1967 | Lee | 86/23 |
| 3,345,903 | 10/1967 | Purdie | 86/23 |
| 3,610,090 | 10/1969 | Corcoran | 86/43 |
| 4,202,245 | 5/1980 | McSpadden | 86/36 |

FOREIGN PATENT DOCUMENTS

| | | | |
|---|---|---|---|
| 1583870 | 2/1981 | United Kingdom | 86/23 |

*Primary Examiner*—Leland A. Sebastian

*Attorney, Agent, or Firm*—Wheeler, House, Fuller & Hohenfeldt

[57] ABSTRACT

A cartridge reloader having a base. A turret ring mounted to and above the base. A turret having a radially extending flange or rim, the turret being rotatable in the ring for positioning dies that act on a cartridge to be reloaded. Radially inwardly extending lugs on the wall of the ring surrounding a large bore therein. Radially outwardly extending lugs on the turret which interlock with the lugs on the ring while at the same time the turret flange is bearing over its area on the margin of the ring surrounding the large hole. An axially slotted ram having a cartridge holder. A T-shaped priming arm having multiple primer holders. The priming arm nesting in and pivotal in a V-shaped socket in the base. A box having inserts for mounting the reloader base on it.

6 Claims, 6 Drawing Figures

73
68
69
70
76
71
79
50
78
60
52
53
59
74
49
65
40
58
64
63
51
66
72
41
44
14'
36
6
14
88
37
35
87
83
13
6
11
10
81
80
84
85
31
103
104
29
21
12
102
18
28
19
25
19'
20
23
22
20
15
94
92
88
91
89
93
83

PRESS FOR RELOADING RIFLE AND PISTOL CARTRIDGES

BACKGROUND OF THE INVENTION

This invention relates to a hand-operated press for reloading cartridges used in pistols and rifles. In particular, the press is for removing spent primers from cartridges, inserting new primers, sizing the cartridges, refilling them with powder and inserting bullets in them.

SUMMARY OF THE INVENTION

The new reloading press comprises a base casting as do prior art presses but, because of the way forces are distributed in the operating components of the press, can be constituted by an aluminum die casting instead of cast iron as in most prior art cases.

Reloading presses are provided with a turret on which there are dies that are selectively rotated into alignment with an empty cartridge to permit driving out the spent primer and sizing with one die and then rotating the turret for inserting a bullet with another die. In prior art presses, the turrent usually rotates on a central pin and the dies are displaced radially from the pin. This results in the turret being subjected to a cantilever action when the force of a ram that pushes the cartridge is applied radially from the pin during the primer removal, cartridge sizing, and bullet insertion sequence. Repeated application of cantilever forces to the turret in prior art presses causes freeplay and wear to occur in the turrent with the result that the cartridges become poorly aligned with the dies so the cartridge and bullet may be deformed and misaligned. Moreover, when the turret in prior art presses is tightened down to reduce freeplay, the turret becomes hard to turn.

In accordance with the invention, the turret is retained and rotated on its outside diameter. That is, it is mounted and rotates on its rim, comprised of radially extending flange elements in the illustrated embodiment, rather than on a central pin as in the prior art. The turret is interlocked with the base in a fashion that allows it to be easily rotated for aligning the dies with a cartridge on the ram and the turret can be removed and exchanged with another without the need for unfastening the turret from a pin as is required in prior art presses.

A unique priming arm is used in the new press. The priming arm positions the new primers for insertion in the cartridge. In prior art presses, the priming arm is usually pivoted on a fixed pin and there is one primer guide mounted on the arm. Priming arms are designed to swing into a slot in the ram of the press so that when the ram is retracted axially with a cartridge on it, the new primer will be driven into the cartridge. The practice heretofore has been to have a primer post and guide assembly of a particular size mounted on the primer arm. When use of another primer size was desired, the post and guide assembly previously used had to be removed from the priming arm and replaced with another or the arm had to be unpinned to replace it with an arm on which a primer post and guide assembly of another size was mounted.

In accordance with the invention, the priming arm pivots in a socket as opposed to pivoting on a pin. The arm is essentially T-shaped. Each branch of the head of the T has a primer guide of a particular size in it. To convert from use of a primer guide of one size to another it is only necessary to lift the priming arm out of the socket, turn it 180° and deposit it back in the socket whereupon it is ready to execute its pivotal action.

In accordance with the invention, the new press does not have to be bolted to a rigid bench as is customary. Instead, a wooden box that is used for storing or transporting the press is made of two parts which are hinged together. A side of the box is provided with treaded inserts on one side. The two parts of the box are swung open to create a predetermined angle between them. Machine screws are then inserted through holes in the base of the press for threading into the inserts whereupon the angularly spaced apart parts of the box provide a stable foundation for the press.

How the foregoing features and other features of the new press are implemented will appear in the more detailed description of a preferred embodiment of the press which will now be discussed in reference to the drawings.

DESCRIPTION OF A PREFERRED EMBODIMENT

Figure 1:
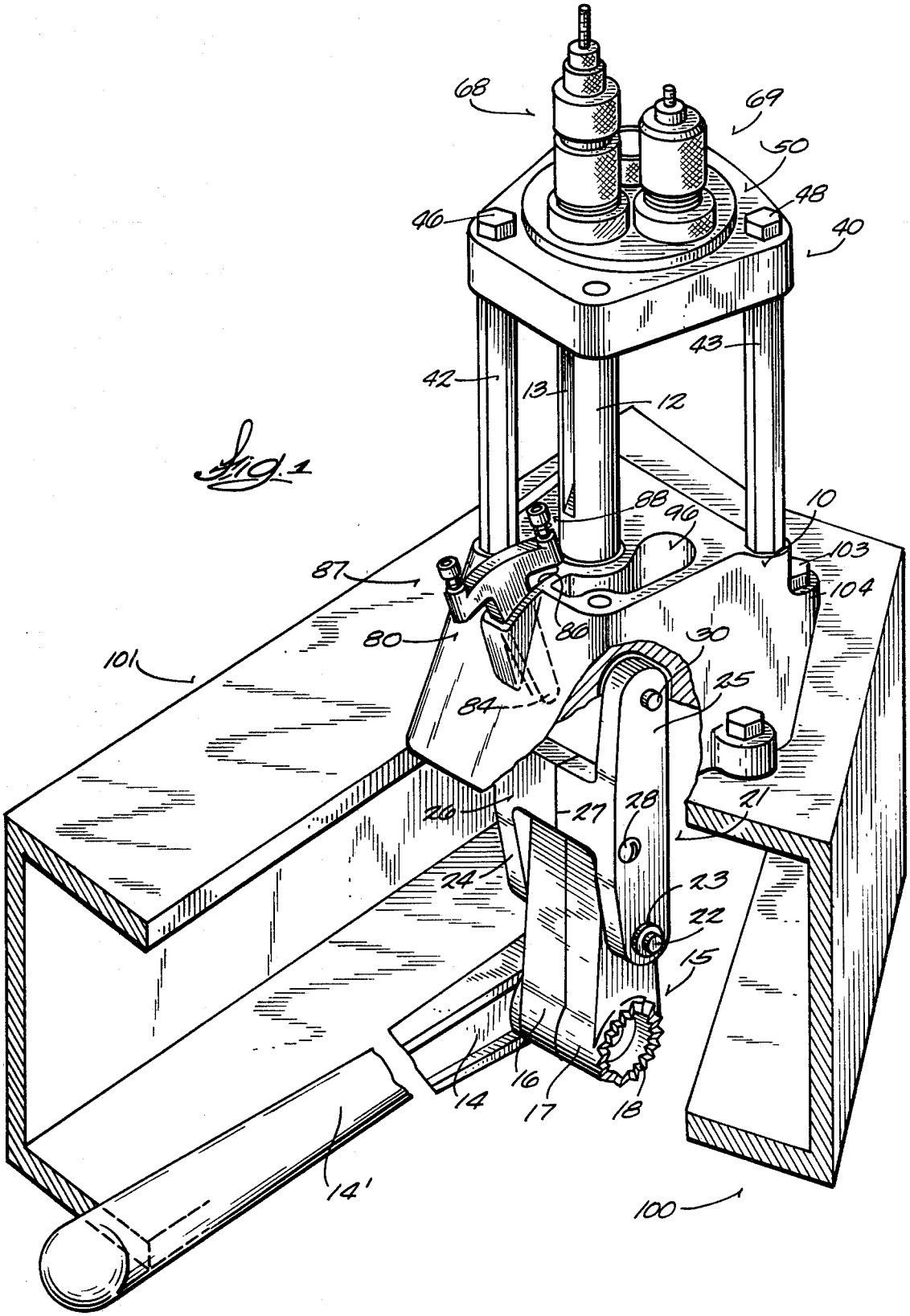
FIG. 1 is a perspective view of the new press, with parts broken away, showing the press mounted on its storage box.
Figures 2, 6:
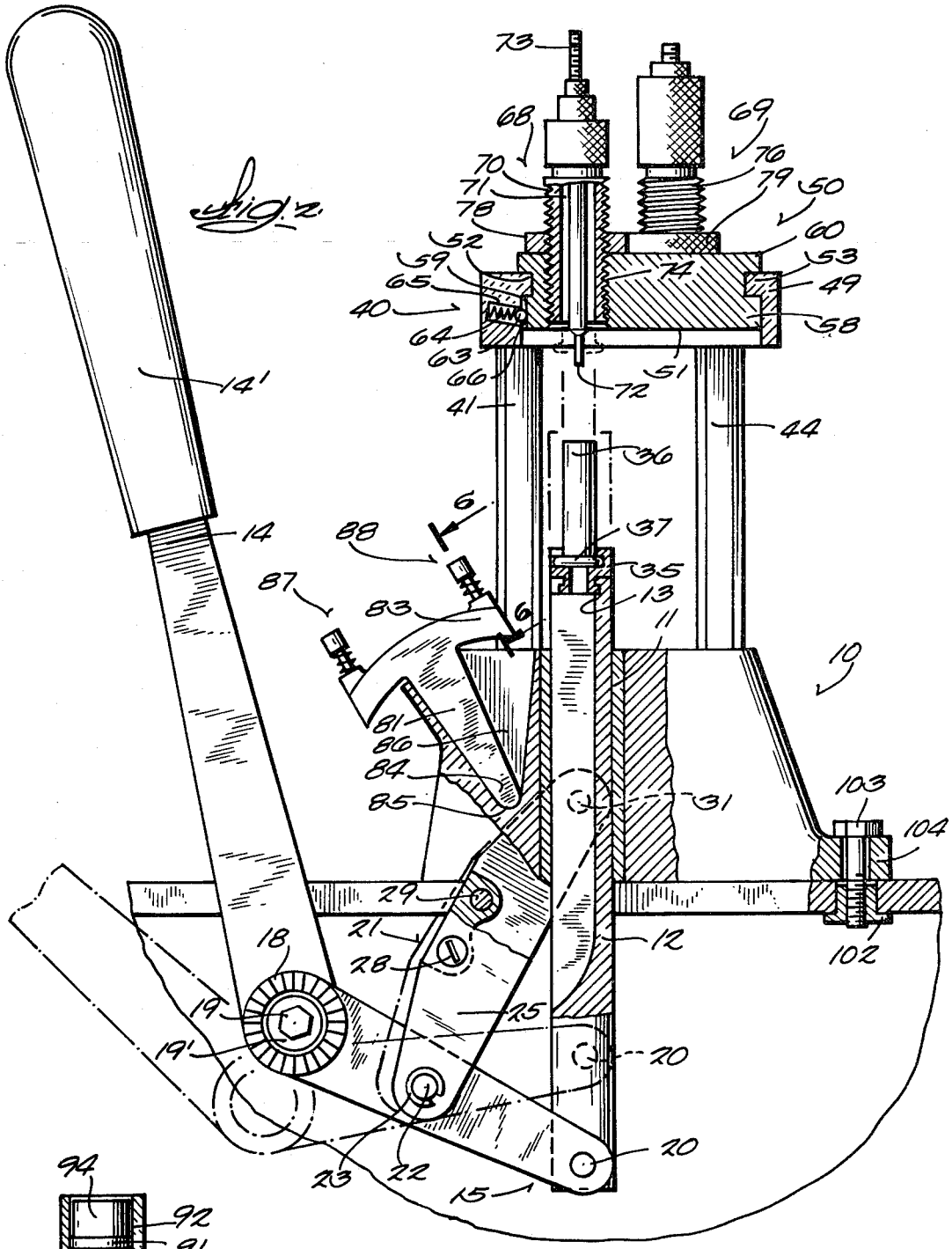
FIG. 2 is a vertical section through the press.
FIG. 6 is a section of a primer post and guide assembly taken on a line corresponding to 6—6 in FIG. 2.

Referring to FIGS. 1 and 2, the reloading press comprises a body or base casting which is generally designated by the reference numeral 10. As can be seen in FIG. 2, the casting is provided with a bore 11 in which there is a vertically reciprocable ram 12. The ram has an axially extending groove or slot 13 in its side.

A compound lever system drives ram 12 axially in opposite directions. The lever system comprises a manually engageable lever 14 that has a hand grip 14'. This lever is rigidly clamped to a link which is generally designated by the numeral 15. Link 15 comprises two identical parts which are marked 16 and 17 in FIG. 1 and have left and right side integral annular serrations, respectively, such as the right side serration marked 18 in FIG. 1. The end of lever 14 has a complementary serration, not visible in FIG. 1, which meshes with serration 18 so that the lever can be arranged at any angle with respect to link assembly 15. Moreover, the lever can be coupled to the link on either the right or left side or the latter. A bolt 19 and washer 19' and a nut, not visible in FIG. 2, fastens lever 14 to link assembly 15. Link assembly 15 connects to the free end of ram 12 by means of a pivot pin 20.

Link assembly 15 has another link assembly 21 pivotally connected to it with a pin 22 that is retained by a snap ring 23. Link assembly 21 is also made in two identical parts 24 and 25. These parts have inwardly extending bosses 26 and 27 that are visible in FIG. 1. As can be seen in FIG. 2, link members 24 and 25 are held together by means of two screws 28 and 29. Link assembly 21 is pivoted to the body 10 on a pair of pins such as the one marked 30 in FIG. 1 and 31 in FIG. 2. These pins pass through the walls of the base 10.

As shown in FIG. 2, rotation of the handle 14 counterclockwise, as is illustrated in phantom, causes the ram 12 to be driven upwardly until it reaches its maximum upward position as depicted in FIG. 1. Link assemblies 15 and 21 execute a toggle action to maximize the driving force of the ram as it reaches the limits of its stroke.

The upper end of ram 12 is equipped with a known type of cartridge holder 35 in which a cartridge 36 that is to undergo primer removal, resizing and primer and powder and bullet insertion is depicted. The cartridge holder enegages the rim 37 of the cartridge for stabilizing it. As is known, it is simply a grooved and opensided slot into which the rim of the cartridge is inserted for reloading it.

Figure 5:
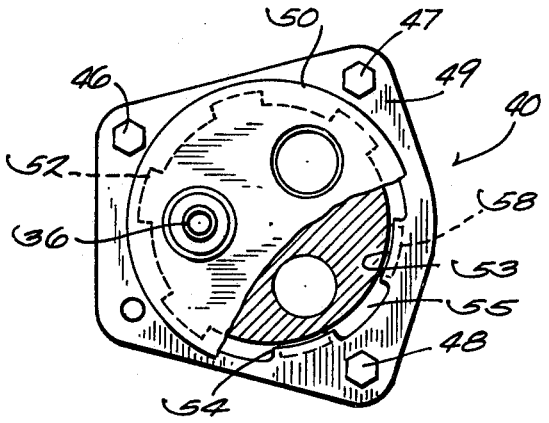
FIG. 5 is a plan view of a ring member in which the turret is retained and rotates.

A turret assembly, generally designated by the numeral 40, is mounted above base 10 on three posts 42–44 in a horizontal plane to which the ram 12 is perpendicular. The lower ends of the posts, not shown, are cylindrical and have a thread for screwing into base 10. As shown in FIG. 1, the top of base 10 has an extra internally threaded hole 56 and turret ring 40 has an extra hole for facilitating installing post 42 to the right of ram 12 instead of to its left as shown. This option is provided to avoid having the post in an interfering position for a right or lefthanded user. Turret assembly 40 is comprised of two major parts, namely, a stationery turret ring 49 and a rotatable turret 50. Turret ring 49 is fastened to posts 42, 43 and 44 by means of machine screws 46–48. Turret 50 is shown isolated from the press in FIG. 4 and a plan view of the turret assembly is shown in FIG. 5 where turret 50 is fitted into turret ring 49.

Turret ring 49 has a large bore 51 so, as can be seen in FIG. 2, its bottom is open. At the top of the bore, turret ring 49 has six radially inwardly extending lugs such as those marked 52 and 53 in FIG. 2. As can be seen in FIG. 5, these radially inwardly extending lugs are spaced 60° apart around the upper end of the bore 51 in the turret ring 40. A typical gap between two of the lugs 53 and 54 is marked 55 in FIG. 5. The gaps such as 55, of course, occur every 60° around the turret ring on each side of the lugs.

Figure 4:
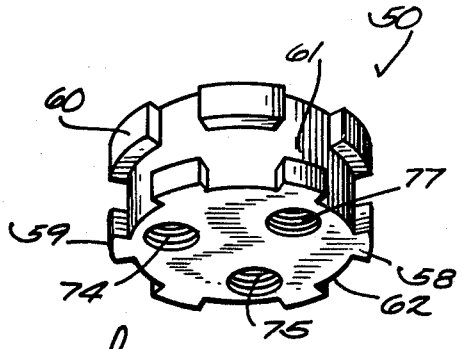
FIG. 4 is a perspective view of the turret which has threaded holes for receiving the dies that size the cartridge and insert the bullet.

As can be seen in FIG. 4, rotatable turret 50 is provided with six radially outwardly extending lugs such as the lugs marked 58 and 59 in the illustrated embodiment. Turret 50 has a radially outwardly extending rim or flange 60 comprised of flange segments and there is an annular space 61 between the bottoms of the flange segments and the top of the radially outwardly extending lugs. The flange is made in segments 60 to facilitate withdrawing the turret from the mold in which it is die cast. The flange could be made without interruptions, however. The lugs in FIG. 4 have angularly spaced gaps such as the one marked 62 between them. These gaps are 60° apart as are the lugs. The circumferential length of the lugs on the turret is slightly less than the circumferential length of the gaps 55 between the six radially inwardly extending lugs on the turret ring 50. Hence, the turret can be inserted into the turret ring by aligning or registering the radially outwardly extending lugs on the turret 50 with the gaps between the radially inwardly extending lugs on the turret ring to thereby fit the turret into the turret ring. The turret is then turned 30° to slide the radially outwardly extending lugs on the turret under the radially inwardly extending lugs on the turret ring to thereby lock the turret into the ring. Rotating the turret in 30-degree steps alternately positions it for removal or for being locked by the coaction of the interfacing lugs on the turret and the turret ring. Observe that when the turret 50 is positioned in turret ring 49 as in FIG. 2, the segmented flange or rim 60 of the turret bears on the flat top surface on the wall of the turret ring and the lugs lock the two parts together under the rim. As a result of the turret being supported and locked at its rim, the turret cannot rock when it is subjected to the force of the ram.

The turret is provided with means for indexing it in rotational positions which are 120° apart in the illustrated embodiment. By way of example, indexing the turret to definite angular positions is achieved with the use of a typical detend ball 63 that is biased radially inwardly with a spring 64 that is disposed in a radial hole 65 in the turret ring 49. The rim of the hole is peened slightly inwardly to retain ball 63 in the hole. The outside of the turret 50 is provided with three 120° spaced apart axially extending grooves such as axially extending groove 66 into which the detent ball 63 registers to latch the turret in a definite rotational angular position. Three detents spaced 120° apart are preferably employed. It should be evident that the hole for the detent spring and ball could be in the turret and the axial grooves in which the ball registers could be in the stationary turret ring.

The turret has a conventional cartridge sizer and deprimer die 68 and a conventional bullet crimping die 69 screwed into it. Referring to FIG. 2, sizer and deprimer die 68 has an external thread 70 for screwing it into a corresponding thread in turret 50. The inside bore 71 of the die has the shape of the outside of the particular cartridge 36 so that when the cartridge is forced into the die by action of ram 12, the cartridge will be restored to its original size and shape. There is also a center deprimer pin 72 in die 68. It is axially adjustable on a thread 73. When die 68 has been indexed rotationally on the turret to a position of alignment with cartridge 36, the cartridge can be driven upwardly with ram 12 sufficiently high for pin 72 to drive the spent primer out of the rim end 37 of the cartridge.

It will be noted in FIG. 4 that the turret has three threaded holes 74, 75 and 76. Threaded hole 74 is for receiving the external thread on sizer and deprimer die 68, for example. Threaded hole 75 is for receiving the external thread 76 on the bullet crimper or seater die 69. The third hole 77 is available for pouring powder into the cartridge after a new primer has been inserted in it and hole 77 is indexed to alignment with the top open end of the cartridge 36. A funnel, not shown, is usually used to insert the powder. Typically, dies 68 and 69 are locked against rotation with externally knurled lock nuts such as those marked 78 and 79.

Figure 3:
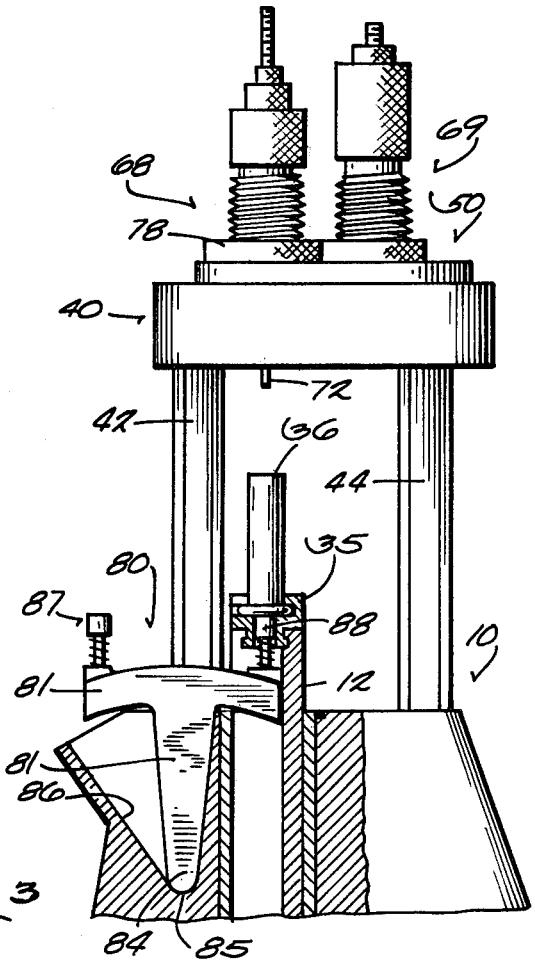
FIG. 3 is a partial section of the press which is presented to show how the priming arm cooperates with the ram of the press.

As can be seen in FIGS. 1–3, the press is provided with a priming arm which is generally designated by the numeral 80. This arm is basically T-shaped, having a leg 81 and two wings 82 and 83. The rounded lower end or tip 84 rests in complementarily rounded apex or bottom 85 of a generally V-shaped socket or slot 86 in the base 10. Thus, primer arm 80 is adapted to rock in the socket 86 between a vertical position in which it is shown in FIG. 3 and an outwardly angulated position in which it is shown in FIGS. 1 and 2. The priming arm is provided with two primer guide assemblies 87 and 88. A typical assembly 88 is shown in FIG. 6. It comprises a pin 89 which is press fitted into wing 83 of the primer arm 80. The top of the pin has an integral flange or head 91. A primer guide or cup 92 is pressed or yieldably supported against head 91 by means of a spring 93. An unused primer cap 94 is shown inserted in cup 92.

Primer guide assembly 87 is constructed similarly to the guide depicted in FIG. 6. The only difference is that its headed pin and cup is dimensioned for accommodating a primer that has a size which differs from primer 94. Primer guide assembly 88 is the one that would be utilized for the position in which the priming arm 80 is depicted. When it is desired to switch to use of the other sized primer, it is only necessary for the operator to lift primer arm 80 out of socket 86 and rotate the arm 180° so that the other primer assembly 87 can be swung into the path of ram 12 as is required for inserting a primer in the cartridge.

As can be seen in FIG. 1, the top of base 10 of the press has a cavity 96 in which used primers that have been driven out of the cartridges may be deposited to avoid the untidiness that results from simply letting the removed primers fall on the floor or the bench on which the press is located. Since the primers are tiny, many of them can be accumulated in cavity 96 before it becomes necessary to invert the press to spill out the spent primers.

The press can be provided to users in a box which is shown in section in FIG. 1 and fragmentarily in FIG. 2. The box comprises bottom part 100 and a top part 101. These parts are hinged to each other at a joint between them, the hinge not being visible in FIG. 1. In any event, the two parts 100 and 101 of the box can be swung on the hinge into an angular relationship with each other as shown in FIG. 1 to allow the box to be used as a foundation for the press. This makes it possible to use the press almost anywhere without being required to clamp it to a benchtop or the like as is customary. As can be seen in FIG. 3, the side walls of the box have flanged inserts, such as the one marked 102 in FIG. 2, pressed into them. Typically, machine screws such as the one marked 103 are passed through pads 104 which extend laterally from base 10 of the press and into the threaded inserts 102 to anchor the press to the box.

Operation of the press will be described in reference to FIG. 2, primarily. As shown, when the ram 12 is in its lowermost position a spent cartridge 36 is pushed into the slot in cartridge holder 35. At this time, sizer and deprimer die 68 has been positioned in alignment with the cartridge by indexing the turret 50 to one of the definite positions in which it is detented. When the foregoing conditions are met, handle 14 is swung counterclockwise to drive ram 12 upwardly and push the cartridge 36 into the bore of die 68 whereupon pin 72 will drive the spent primer out of the rim end of the cartridge and the bore of the die will size and reshape the cartridge. With the ram and cartridge still up, priming arm 80 is pivoted clockwise to dispose primer post assembly 88 within the longitudinally extending slot 13 in the ram. Handle 14 is then swung clockwise and cartridge 36 is pulled down to drive the primer which is in the spring biased cup of the priming post assembly into the rim end 37 of the cartridge. This is shown particularly well in FIG. 3. The cup, which is spring biased upwardly to retain the primer, yields downwardly in opposition to the biasing spring. When the primer is seated, ram 12 is moved upwardly slightly by rotation of handle 14 through a small counterclockwise angle and primer arm 80 is angulated out of the slot in the ram to the position in which it is shown in FIG. 2.

Now that the cartridge is primed and sized, the turret 50 is rotated sufficiently to align hole 77 in the turret with the cartridge and the powder is fed through the hole in the turret to the cartridge. Next, the bullet seater die 69 is aligned with the ram by rotation of turret 50 120° from its previous position in this embodiment. With the ram retracted downwardly, the bullet is inserted in the top end of cartridge 36 and the ram is driven into bullet seater die 69 which compresses the powder by forcing the bullet inwardly of the cartridge. At the last part of the ram stroke, the bullet die exerts a radially inward or crimping force on the cartridge wall so as to squeeze the wall tightly against the bullet. Reloading is then complete.

As indicated earlier, for differently sized and shaped cartridges, different dies 68 and 69 would be used and, if the primers for the particular cartridges are different than what was previously used, primer arm 80 would be lifted out of socket 86 and rotated 180° for making it possible to put the other primer post assembly 82 in the path of the cartridge.

Although a preferred embodiment of the new press has been described in detail, such description is intended to be illustrative rather than limiting, for the inventive features may be variously embodied and are to be limited only by interpretation of the claims which follow.

I claim:

1. A press for reloading cartridges comprising:

a base member, an elongated ram mounted for moving axially upwardly and downwardly on the base member and a holder at an end of the ram for holding a cartridge, means for driving the ram axially in opposite directions, a turret ring and means for supporting said turret ring rigidly above the base member in a plane that is transverse to the axis of the ram, said turret ring having an axially directed bore and bearing surface means on said ring circumjacent the nominally upper end of the bore, a generally circular turret for supporting dies that act on said cartridge, said turret having radially outwardly extending flange means radially remote from its center which outwardly extending flange means interface with said bearinng surface to support said turret for rotating in in said bore of the turret ring, and means for restraining said turret from moving axially upwardly when a force is applied to it by the ram.

2. A press for reloading cartridges comprising:

a base member, an elongated ram mounted for moving axially on the base member and a holder at an end of the ram for holding a cartridge, means for driving the ram axially in opposite directions, a turret ring and means for supporting said turret ring rigidly above the base member in a plane that is transverse to the axis of the ram, said turret ring having an axially directed bore and a plurality of lugs extending radially inwardly of the bore, said lugs being angularly spaced apart around the bore and defining angularly spaced apart gaps between them, a generally circular turret for carrying dies and for fitting into and for rotating in the bore of the turret ring, said turret having a radially extending flange whose diameter is greater than the diameter of the bore so the flange will interface with the turret ring around said bore to thereby support the turret over an area that is radially spaced from its center, said turret having a plurality of radially outwardly extending lugs angularly spaced apart around it and defining angularly spaced apart gaps between them, said lugs being axially spaced from said flange on the turret, said turret being freely insertable and removable from the turret ring when the lugs on the turret are registered with the gaps between the lugs on the turret ring and said turret being retained in the turret ring against axial movement when the turret is rotated to a position wherein the lugs on the turret are under the lugs on the turret ring, and means for engaging dies with the turret for the dies to perform a sequence of operations on the cartridge when the turret is rotated to positions wherein it is retained and the dies are sequentially aligned with the ram.

3. A press for reloading cartridges comprising:

a base member, an elongated ram mounted for moving axially on the base member and a holder at an end of the ram for holding a cartridge at its rim end, said ram having an axially extending slot in its side, a generally circular turret and means for supporting the turret for rotation in a plane to which the axis of the ram is perpendicular, said turret having a plurality of threaded holes radially spaced from its center and angularly spaced apart around its center, one of said holes being for receiving a die used for driving a spent primer out of a cartridge and for sizing the cartridge when the cartridge is driven into the die by the ram and another of which is used for fixing a bullet in said cartridge when it is driven into said other die by the ram, manually operated means for driving said ram toward and away from said turret, said base having a generally V-shaped socket adjacent said axially extending slot in the ram, a priming arm having a leg portion for fitting into said socket and having a tip on the leg portion which nests in the apex of the V-shaped socket so the arm can swing toward and away from said ram, said priming arm having oppositely disposed wings at an end of the leg opposite from said tip, each of said wings having primer supporting and releasing means thereon respectively for primers of different sizes, said wings being aligned with the slot in the ram when the priming arm is in the socket, said priming arm being swingable to dispose one of the wings and the primer supporting and releasing means in the slot of the ram for enabling a primer of one size to be forced into the cartridge under the influence of axial movement of the ram and said priming arm being free to be lifted out of said socket, rotated and returned to said socket to allow disposing the other of the wings and the primer supporting and releasing means thereon in said slot.

4. The press as in any of claims 2 or 3 wherein said base member has a cavity formed in its top for collecting primers that have been removed from cartridges.

5. The press as in any of claims 1, 2 or 3 wherein said base member has a plurality of lateral extensions arranged in a predetermined pattern, the extensions having a hole through them, a box for containing said press, said box comprising two hollow parts that are hinged together and swingable in an angular relationship with each other, said parts having internally threaded inserts fixed in corresponding sides, said inserts being located so they will coincide with the pattern of said holes when said parts have a predetermined angle between them whereby said base member can be fastened to the box with screws that pass through the holes and screw into said inserts.

6. The press as in any of claims 2 or 3 wherein said means for driving the ram comprises:

first link means having a pivotal connection between one of its ends and the end of the ram remote from said turret, the other end of said link having a hole and serrations surrounding said hole on each side of the link means, an elongated operating handle having a hole in one end and serrations surrounding the hole on at least one side of the handle, to thereby adapt the handle for its serrations to be selectively meshed with the serrations one one or the other sides of the link means, second link means having a pivotal connection to the base member at one end and a pivotal connection at its other end to said first link means intermediate of the ends of the first link means.

* * * * *